United States Patent [19]

Griffin, Jr.

[11] 3,990,191

[45] Nov. 9, 1976

[54] METHOD FOR REMOVAL OF PAPER FROM DYE SPRINGS

[75] Inventor: Charles Everett Griffin, Jr., High Point, N.C.

[73] Assignee: Burlington Industries, Inc., Greensboro, N.C.

[22] Filed: Jan. 27, 1975

[21] Appl. No.: 544,670

[52] U.S. Cl. ..... 51/313
[51] Int. Cl.[2] ..... B24B 1/00
[58] Field of Search ..... 51/313, 314

[56] References Cited

UNITED STATES PATENTS

| | | | |
|---|---|---|---|
| 723,180 | 3/1903 | Porter | 51/314 X |
| 2,174,880 | 10/1939 | Hilbish | 51/313 |
| 3,452,490 | 7/1969 | McLean | 51/314 |

*Primary Examiner*—Harold D. Whitehead
*Attorney, Agent, or Firm*—Cushman, Darby & Cushman

[57] ABSTRACT

Filter paper and the like is removed from yarn dye springs by impacting a plurality of springs against each other and against a surface, as by elevating them and then effecting tumbling thereof. Tumbling apparatus includes a conveyor for elevating the springs, guide means for guiding the conveyor in a particular path, and surface formations for providing for impaction of springs thereagainst. A suction device or the like may be provided for removal of the paper that has been separated from the springs from the tumbler volume while tumbling is still taking place.

10 Claims, 4 Drawing Figures

METHOD FOR REMOVAL OF PAPER FROM DYE SPRINGS

BACKGROUND AND SUMMARY OF THE INVENTION

The invention relates to the removal of filter paper from yarn dye springs. For the purposes of yarn dyeing, wire stainless steel springs are wrapped with filter paper. After wrapping with filter paper, the paper is affixed to the springs with a water-soluable adhesive. Then the springs are wound with yarn to thereby form a "yarn package", and are compressed onto a yarn spindle carrier. In this compressed state, the yarn packages are dyed. Although dyeing dissolves the adhesive holding the filter paper portions together, the filter paper still has a tendency to stick and become intermeshed with the coils of the springs because of the compression thereof, and even after unwinding of the yarn from the springs, the filter paper remains.

In order to effectively reuse the dye springs, it is necessary to remove the old filter paper, and replace it with new filter paper. In the past this has been done by hand, an extremely costly and slow process. Proposals have been made to remove the paper in batches by burning it off, however, such proposals are not realistic since deposits would be left on the springs, and their resiliency would be impaired as a result of the extreme heat that would result.

According to the present invention, the filter paper is effectively removed from the dye springs by subjecting the springs to rough action such as by impacting them against one another, and agaiinst a rough stationary surface — as by tumbling them. This has been found to be effective in removing all filter paper from approximately 95% of all dye springs — the other 5% may readily be treated by hand. This tumbling may be accomplished by a conveyor adapted to travel in a semicircle having a plurality of spaced "pushers" associated therewith which result in periodic movement of the springs upwardly, to be released to provide tumbling falling thereof. A suction fan may be associated with the apparatus to effectively remove the paper released by the tumbling action. While prior art devices for the tumbling of articles have been known — see U.S. Pat. Nos. 3,073,077, 3,079,735, 3,715,084, and 2,212,560 for example — it has not been known to remove filter paper from dye springs by tumbling, nor has the preferred apparatus for accomplishing this result according to the teachings of the present invention been known.

U.S. Pat. No. 3,715,840 shows a conveyor belt adapted to traverse a particular path and having extensions formed thereon, but does not show particular conveying means according to the apparatus of the present invention, especially adapted for tumbling dye springs. U.S. pat. Nos. 3,073,077 and 3,079,735 show particular conveyor slat members, however, they do not suggest particular frame means and guiding means associated therewith according to the present apparatus. U.S. Pat. No. 2,212,560 shows a fan associated with a tumbler, however, the fan is merely for the drying of the work articles — silverware — and is not a suction fan for the removal of paper from the tumbling chamber.

It is the primary object of the present invention to provide an improved method — and apparatus for practicing the method — for the removal of filter paper from dye springs. This and other objects of the invention will become clear from an inspection of the detailed description of the invention and the appended claims.

DETAILED DESCRIPTION OF THE DRAWINGS

Figure 1:
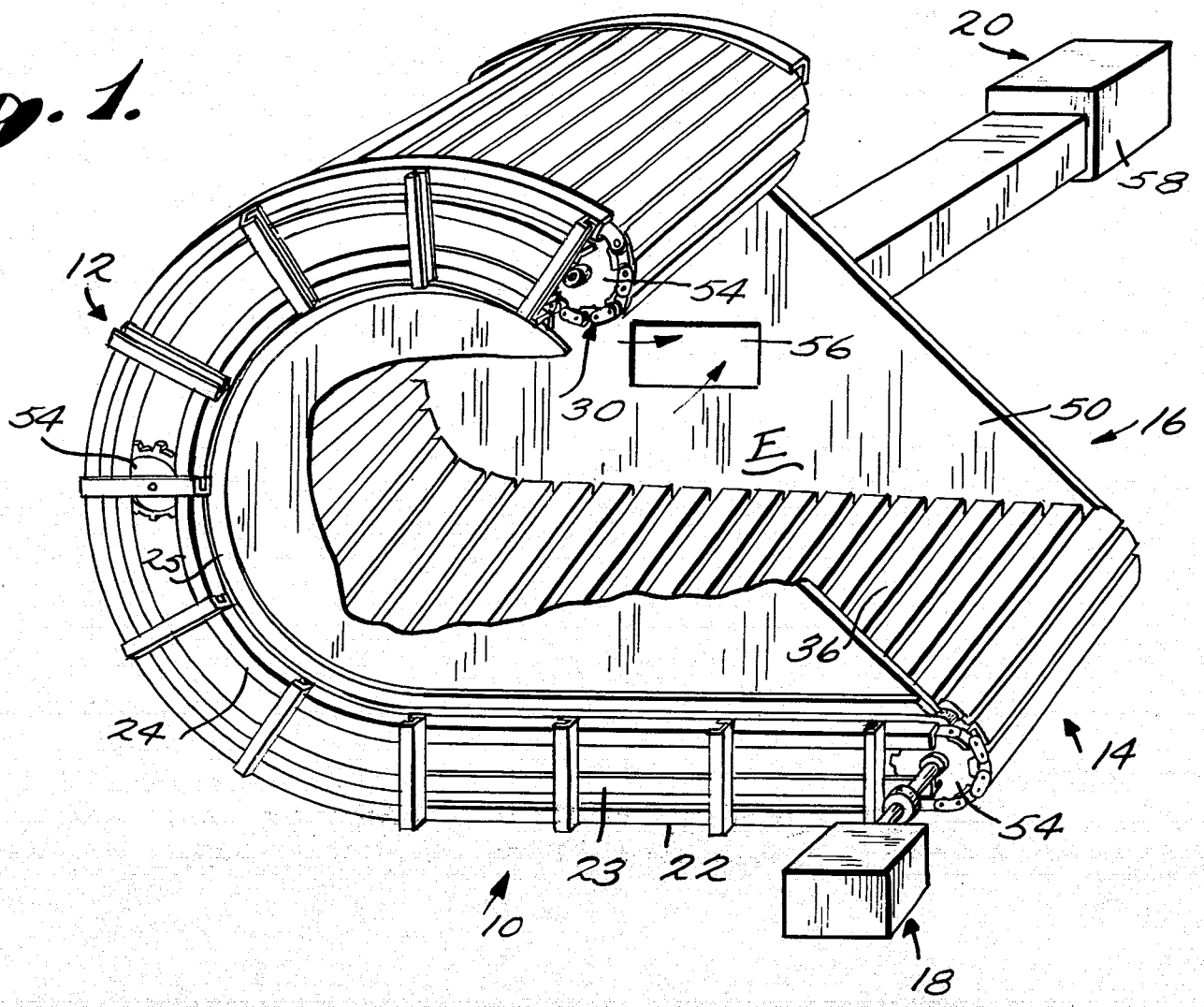
FIG. 1 is a perspective, somewhat diagrammatic view with portions cut away of exemplary tumbling apparatus according to the present invention.

Exemplary apparatus according to the present invention for practicing the method of the present invention is shown generally at 10 in the drawings. The apparatus 10 consists of several main components: a frame means 12 providing a generally straight section and a semi-circular section, a conveyor means 14 for transporting dye springs A or the like to be tumbled, the path of the conveyor means being guided by the frame means 12, surface means 16 disposed at each side of the conveyor means and extending from the frame means 12 for providing a rough surface against which dye springs A may impact, poweer means 18 for driving the conveyor means 14 along its path of movement, and suction means 20 for withdrawing paper or the like separated from the dye springs A during tumbling from the chamber E defined by the apparatus 10.

Figure 2:
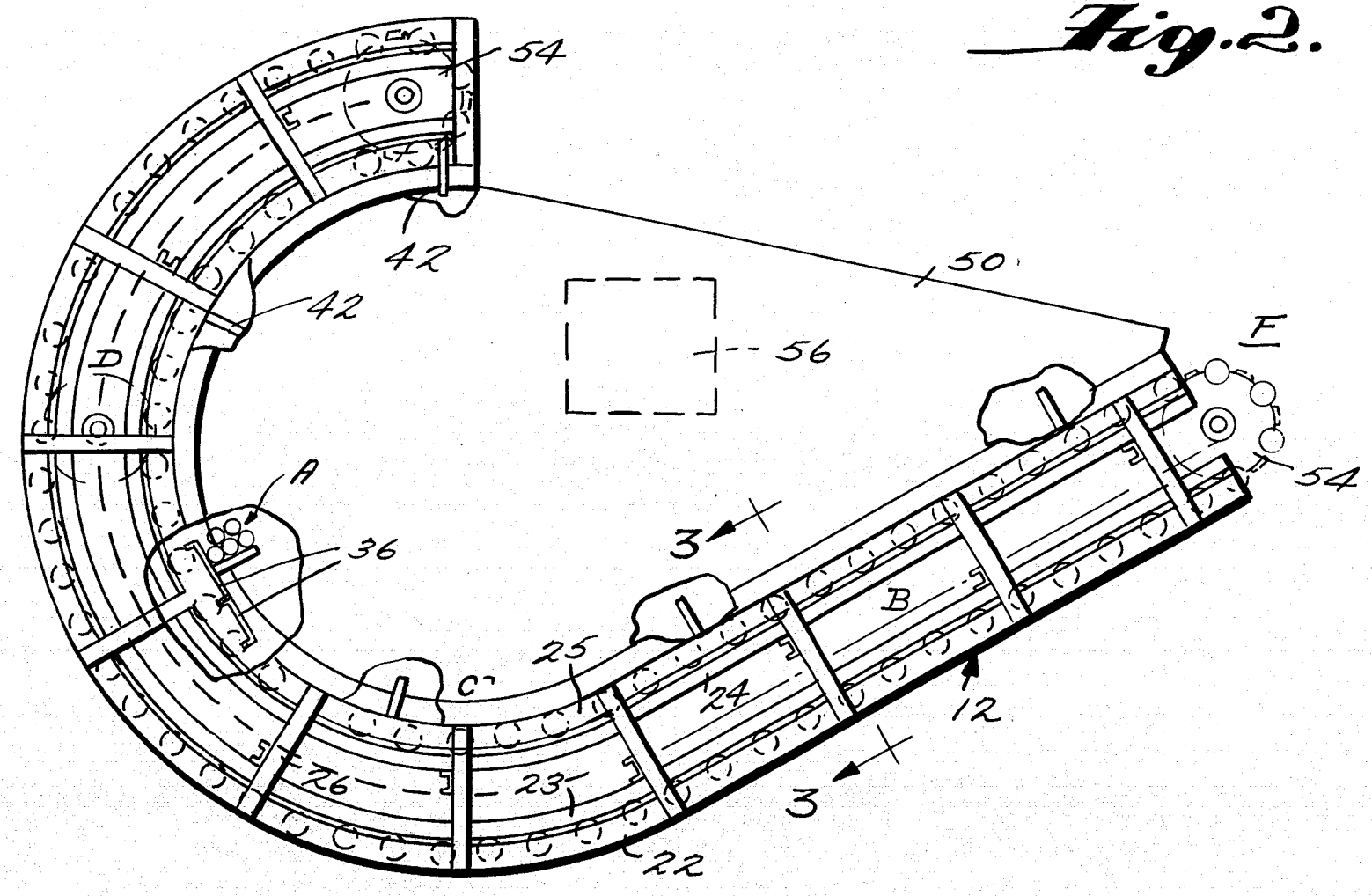
FIG. 2 is a side view with portions cut away of the apparatus shown in FIG. 1.
Figure 3:
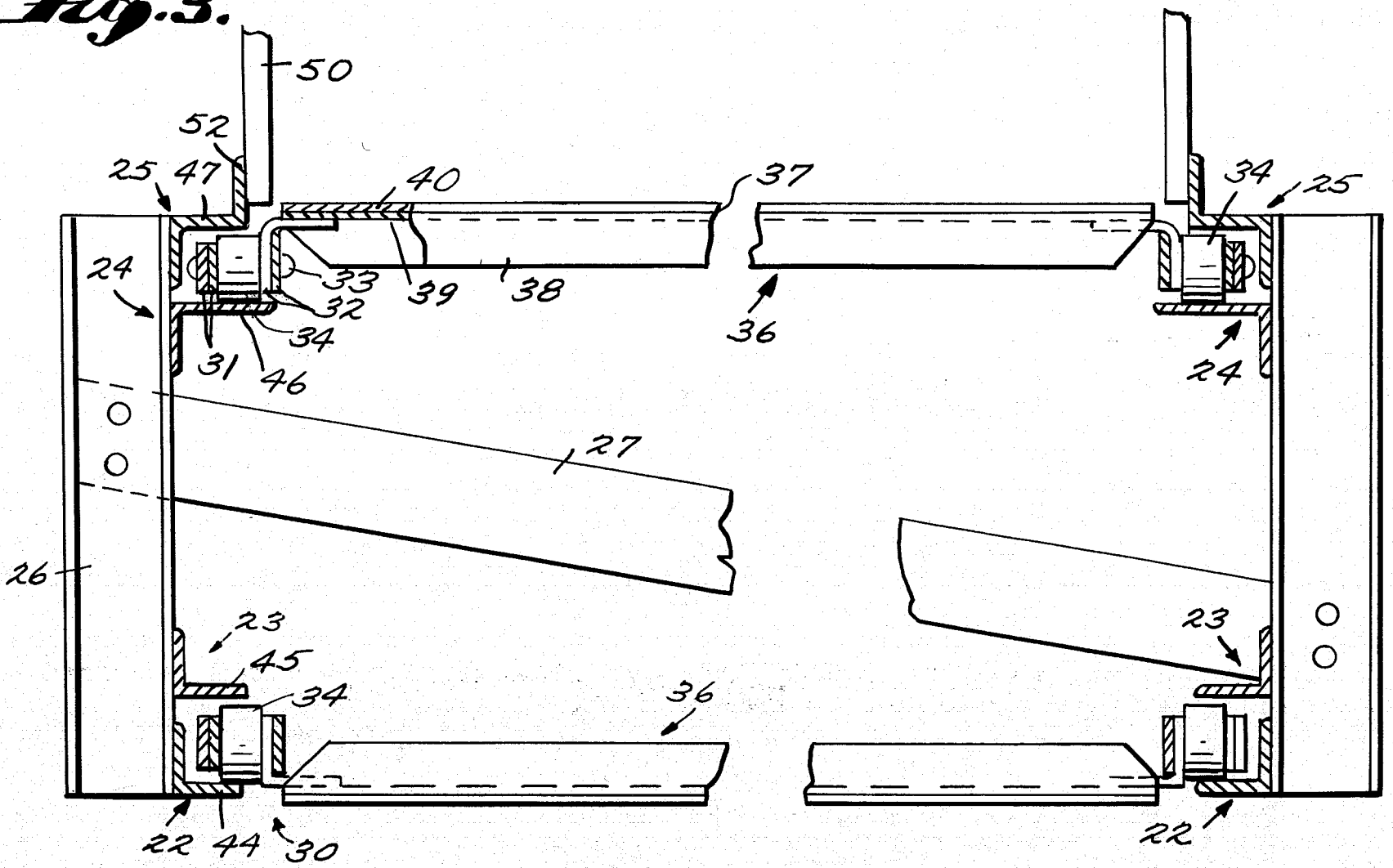
FIG. 3 is a detailed sectional view taken along lines 3—3 of FIG. 2.

As most clearly shown in FIGS. 2 and 3, the frame means 12 for guiding the path of movement of the conveyor means 14 preferably includes a pair of first frame members 22 located on either side of conveyor means 14 to be guided, a pair of second frame members 23 vertically spaced from and parallel to the first frame members 21 for cooperation therewith, a pair each of third and fourth frame members 24 and 25 respectively vertically spaced from and parallel to members 22 and 23 and to each other, the third and fourth frame members 24 and 25 cooperating with each other, and a plurality of supporting members 26 interconnected between the members 22, 23, 24, and 25. A plurality of spacer bars 27 interconnect various bars 26 on opposite sides of conveyor means 14. Supporting means (not shown) for mounting the whole frame means 12 composed of members 22, 23, 24, 25, 26, and 27 mount the frame means 12 on any desired surface in any desired location.

The frame means in combination with sprockets 54 guide movement of the conveyor means 14 so as to provide tumbling action of dye springs A carried by the conveyor means 14. In order to accomplish this, it is preferred that the frame means 12 have a generally straight section B, a lowermost point C, and a half-circle section D extending vertically upwardly from the point C. The semi-circular section D must extend at least more than 90° upwardly from the point C so that dye springs A to be carried by the conveyor means 14 will fall by the action of gravity downwardly toward the lowermost point C during tumbling and will not be carried outwardly from the apparatus 10 by the conveyor means 14. In practice, it is preferred that the section D be a half-circle. For improved tumbling action and to facilitate prevention of the movement of dye springs A outwardly from the apparatus 10 it is preferred that the straight section B be at an angle of approximately 30° with respect to horizontal, leading downwardly toward point C, however, it is to be understood that section C could be of any slope from horizontal (or even less than horizontal) to just short of vertical and the apparatus 10 would still operate.

The conveyor means 14 preferably takes the form of a pair of endless chains 30, each chain cooperating with one set of frame members 22, 23, 24, and 25 and formed of links 31, 32 pivotally connected by pins 33 and spaced apart by spacers 34, and a plurality of slats 36 extending from onee chain 30 to the other and operatively connected thereto. Each conveyor slat 36 preferably has a flat outward face 37, and side walls 38 extending downwardly from the inward face 39 thereof. The face 37 may be coated with a wear surface 40 if desired. Each of the slats 36 are operatively connected at each end thereof to a link 32 of a chain 30.

Extending outwardly from selected ones of said slats 36 are pushers 42, each consisting of a plate having the plane thereof generally perpendicular to the face 37 of slat 36. The pushers engage one or more springs A and carry them upwardly therewith as they move along section D of the conveyor path, and at some point after traveling through an arc of 90° from point C allow the springs A to fall downwardly to the interior of the apparatus 10. Preferably, a pusher 42 is associated with every sixth slat 36.

It is noted that guiding of the conveyor means 14 by the frame means 12 is preferably accomplished by extentions 44, 45, 46, and 47 extending respectively from frame members 22, 23, 24, and 25 for engagement with spacers 34 of chains 30.

Surface means 16 for enclosing the apparatus 10 preferably include a pair of sheets 50 of plywood or the like, one located on each side of conveyor means 14. The sheets 50 and conveyor slats 36 define the chamber E of apparatus 10. As shown most clearly in FIG. 3, each sheet 50 may be mounted by securement to extensions 52 of frame members 25. The sheets 50 are contoured to conform to the profile of the frame means 12. The inside surfaces of the sheets 50 provide a rough surface against which dye springs A may impact, providing for removal of filter paper or the like attached thereto.

The power means 18 for driving the chains 30 of conveyor means 14 may be any suitable power means such as an electric motor. It is preferred that the motor simultaneously drive sprockets 54 pivotally mounted at respective ends of frame means 12. The means 18 is preferably reversible so that after the tumbling operation the conveyor 14 may be driven in reverse to expel the springs A from the apparatus 10.

The tumbling of springs A against each other, against wear surfaces 40 of slats 36, and against sheets 50 will result in the separation of filter paper or the like from the springs. In order to effectively automatically remove this paper from the chamber E so that it will not have a chance to adhere to other dye springs A and so that hand-picking of the dye springs from a mass of springs and separated paper will not be necessary after the tumbling operation, exhaust or suction means 20 are preferably provided. Preferably such exhaust means take the form of an opening 56 located in one of the plywood sheets 50, and an exhaust fan 58 operatively associated therewith. A grate or screen may be placed over the opening 56 to prevent any springs that might inadvertently impact thereagainst from passing through opening 56 while still allowing the passage of paper therethrough. It may be desirable to locate the opening 56 near the top of the sheet 50 so that the chances of a spring A passing therethrough are even more greatly reduced. The power of the exhaust fan 58 is gauged so that paper will readily be swept up with air rushing theretowards while dye springs A will not be disturbed thereby. If desired, an opening corresponding to opening 56 may also be formed in the other sheet 50 to provide for air circulation in the apparatus 10.

Apparatus 10 according to the invention now having been described, the operation thereof will be set forth: A plurality of dye springs A having filter paper or the like intermeshed therewith are deposited into the interior chamber E of the apparatus 10, as by dumping them from a container over the edge F of section B of the frame means 12. Operation of the power means 18 and exhaust fan 58 is then initiated, the springs A within chamber E being engaged by pushers 42 located on slats 36 of conveyor means 14 and carried upwardly therewith along section D of the path of movement of the conveyor means 14. The slats 36 are operatively connected to links 32 of chains 30, which chains are driven by interengagement thereof with sprockets 54, and which are guided along their path of movement by extensions 44–47 of frame members 22–25.

After the springs A carried by pushers 42 reach a point somewhat past a 90° position from point C, they fall downwardly into chamber A, tumbling against each other, wear surfaces 40 of slats 36, and sheets 50, whereby the paper or the like is separated therefrom. The separated paper is then drawn up by exhaust fan 58 through opening 56 in a sheet 50 for ultimate disposal. After the tumbling action has taken place for a sufficient time — i.e., time enough to effectively remove all paper that may satisfactorily be removed therewith (all paper from approximately 95% of all springs A) — the power means 18 and exhaust fan 58 are stopped, and the power means 18 is put into reverse, providing for removal of springs A from chamber E by pushers 42 of conveyor 14 carrying them along section B over the edge F thereof, out of the chamber E. The dye springs A are now ready for use in another yarn dyeing operation.

Figure 4:
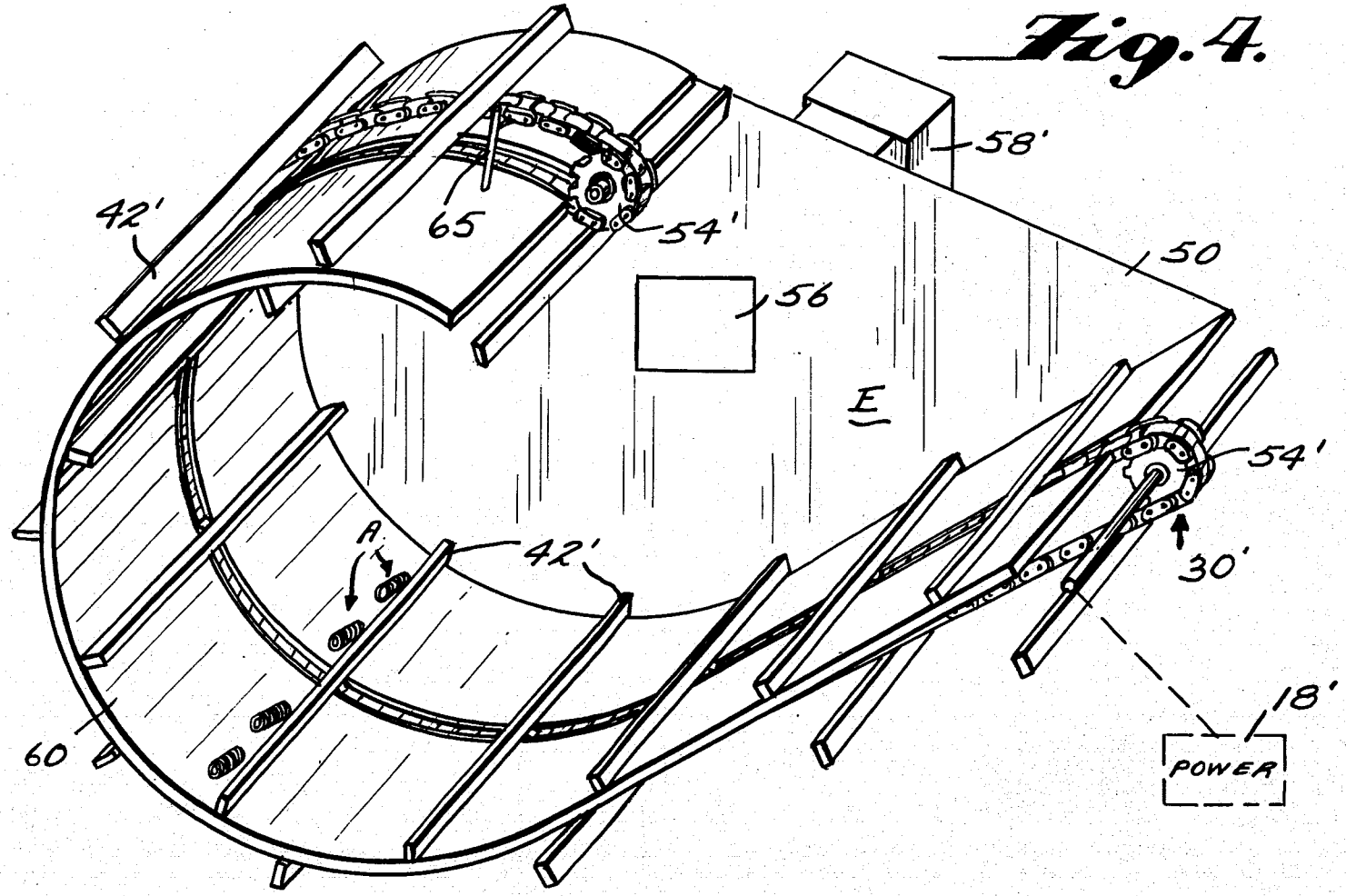
FIG. 4 is a perspective view of modified apparatus according to the present invention.

A modified form of the apparatus according to the present invention is shown generally at 10′ in FIG. 4. In this embodiment of the invention, the conveyor means and frame means take a different form. The frame means 12′ includes a pair of stationary plates, 60 and 61, spaced apart by a gap 62, each of the plates being formed into the same shape as the frame members 22–25 of the FIG. 1 embodiment of the invention. A chain 30′ is adapted to be guided for movement in gap 62 along the lengths of plates 60 and 61 from one sprocket 54′ to the other (the sprockets 54′ being driven by power means 18′). Any suitable means — such as guide flanges extending from the plates 60 and 61 — may be provided for guiding of the chain 30′ in gap 62, and any other suitable means — such as brackets 65 — may be provided for guiding chain 30′ along a path spaced from gap 62. Operatively attached to chain 30′ at spaced locations along the length thereof are pusher slats 42′ which extend in a plane generally perpendicular to the plane of links of chain 30′ to which they are attached. The pusher slats engage dye springs A for tumbling thereof. Again, plywood surface means 16′ or the like are provided for defining a chamber E, and an exhaust fan 58' or the like may be provided for removing separated paper from chamber E. Operation of the FIG. 4 embodiment is substantially the same as the FIG. 1 embodiment except that less power is required to provide the tumbling action for a given number of dye springs A since only the relatively few slats 42' must be moved instead of the great mass which slats 36 define.

While the invention has been herein shown and described in what is presently conceived to be the most practical and preferred embodiments, it will be apparent to one of ordinary skill in the art that many modifications may be made thereof within the scope of the invention. For instance, other apparatus for removing separated paper and other apparatus for impacting the springs against one another and a surface — such as a vibrator — could be employed when practicing the method of the present invention. The apparatus according to the present invention could be used to tumble other articles besides dye springs, although it is specially adapted for that purpose, and other surface forming means, drive means, and means for removing separated paper from the chamber E could be employed. Many other modifications are also possible, thus it is intended that the invention be given the broadest interpretation of the appended claims so as to encompass all equivalent methods and devices.

What is claim is:

1. A method for separating filter paper or the like from yarn dye springs comprising the step of assembling a plurality of dye springs with filter paper or the like thereon impacting said dye springs against each other and against a surface for a sufficient time and with sufficient force so that substantially all of said filter paper or the like is separated from substantially each of said plurality of dye springs.

2. A method as recited in claim 1 wherein said impacting is effected by elevating at least a portion of said plurality of springs and then effecting free fall tumbling of said elevated plurality of springs against each other and against a surface.

3. A method as recited in claim 2 comprising the further step of confining said elevation and tumbling of said plurality of springs within a predetermined volume.

4. A method as recited in claim 3 comprising the further step of removing filter paper or the like separated from said dye springs in said volume while impacting is still taking place.

5. A method as recited in claim 4 wherein said step of removing filter paper or the like from said volume is effected by applying a suction of sufficient magnitude to said volume to transport filter paper or the like away from said volume, but not of sufficient magnitude to transport dye springs from said volume.

6. A method as recited in claim 3 comprising the further step of automatically removing said plurality of dye springs from said volume after separation of substantially all the filter paper or the like therefrom.

7. A method as recited in claim 1 comprising the further step of confining said impacting of said dye springs to a predetermined volume.

8. A method as recited in claim 7 comprising the further step of removing filter paper or the like separated from said dye springs in said volume from said volume while impacting is still taking place.

9. A method as recited in claim 8 wherein said step of removing filter paper or the like from said volume is effected by applying a suction of sufficient magnitude to said volume to transport filter paper or the like away from said volume, but not of sufficient magnitude to transport dye springs from said volume.

10. A method as recited in claim 7 comprising the further step of automatically removing said plurality of dye springs from said volume after separation of substantially all the filter paper or the like therefrom.

* * * * *